United States Patent [19]

Grau et al.

[11] 3,990,224

[45] Nov. 9, 1976

[54] OPEN END SPINNING MACHINE

[75] Inventors: Gerhard Grau, Albershausen; Friedrich Eckhardt, Salach, both of Germany

[73] Assignee: Zinser Textilmaschinen GmbH, Ebersbach, Germany

[22] Filed: July 17, 1975

[21] Appl. No.: 596,843

[52] U.S. Cl. ..... 57/58.89; 57/1 R; 57/136

[51] Int. Cl.[2] ..... D01H 1/16; D01H 1/12

[58] Field of Search ..... 57/1 R, 58.89–58.95, 57/136, 137, 92

[56] References Cited

UNITED STATES PATENTS

| | | | |
|---|---|---|---|
| 2,658,327 | 11/1953 | Keyser | 57/92 |
| 2,758,439 | 8/1956 | Bradshaw | 57/136 |
| 3,511,045 | 5/1970 | Bures et al. | 57/58.91 |
| 3,662,532 | 5/1972 | Stahlecker | 57/58.89 |
| 3,756,007 | 9/1973 | Bartling | 57/58.91 |
| 3,774,382 | 11/1973 | Bartling | 57/1 R |
| 3,911,660 | 10/1975 | Stalder | 57/58.89 |

*Primary Examiner*—John Petrakes
*Attorney, Agent, or Firm*—Edwin E. Greigg

[57] ABSTRACT

An open end spinning machine has individual spinning locations which include a spinning rotor, various drive rollers and conduits and drive shafts which are brought into tangential engagement with drive belts or the like. For this purpose, each spinning location is enclosed in a movable housing which can be displaced vertically on a column mounted on the machine by one end. A stop pin in the column cooperates with a rotating ring in the housing and provides therewith a bayonet-like engagement. The motion of the housing in the opposite direction is limited by the angled arm of a lost-motion slide connected to the housing which makes contact with the stop pin in the column. Easy removal without tools permits ready access to the machine space behind each housing.

23 Claims, 7 Drawing Figures

OPEN END SPINNING MACHINE

BACKGROUND OF THE INVENTION

The invention relates to an open-end spinning machine on which are mounted movable housings, each containing mutually parallel spining rotors and associated fiber supply and fiber spreading rollers which have shafts that extend from the housing. By moving the housing, the shafts may be made to engage and disengage drive means located on the machine.

In a known machine of this type (DT-OS No. 2 029 878), these housings are mounted pivotably about horizontal axes. Mounting the housings in this kind of configuration requires the use of tools which is made especially difficult when the housings are to be placed immediately adjacent to one another along the machine so as to achieve a neat allocation of the space on the machine. In that case, it is especially difficult to disassemble one of the housings from the row of housings, for example, in order to exchange it for another housing.

Tools are also required in the mounting or demounting of the housings in those known machines in which the spinning rotor and the fiber delivery and spreader rollers are not located in a common housing but are located in two mutually pivotable housing parts (DT-OS No. 1 535 005), and in this case two separate assemblies or disassembly operations must be performed for each spinning unit.

In another known machine (DT-OS No 2 050 064) in which the spinning rotor is located in one housing while the fiber delivery and spreader mechanism are located in a second housing, these two housings are slidably fastened to a guide mechanism comprising two columns which are mounted in an intermediate frame that is fixed within the main frame of the machine. In this case, the two housings and the intermediate frame to which they are connected by the columns form a construction unit which can be removed from or attached to the machine only with the use of tools. If only an exchange of housings is desired, the constructional unit must first be released from the machine after which the exchange of housings must still be made within the intermediate frame and this also requires tools.

OBJECT AND SUMMARY OF THE INVENTION

It is a principal object of the invention to provide a spinning machine in which the spinning unit is located in a single housing which is mounted on the machine in a simple manner but one which, nevertheless, permits subdividing the available machine space into small, adjacent units and one which may be installed or removed from the machine without the aid of tools.

This object is achieved, according to the invention, by providing a plurality of columns affixed to the machine, there being one column associated with each housing. A housing is movably mounted on a column and is capable of longitudinal motion limited by various stops and arrest mechanisms which provide for a predetermined relative position corresponding to operation, to idling and to maintenance.

In the simplest practical embodimental form, these columns may have vertically standing longitudinal axes with their free ends extending upwardly. The housing, which is mounted thereon and which is secured against unintentional release would, by its own weight, hold the horizontally extending shafts in engagement with the associated drive means on the machine, for example, with appropriately guided tangential drive belts.

A further development and an advantageous feature of the invention is to provide for a plurality of defined arrest positions of the housing on its path of motion on the column, for example, to provide for an operational position, an idling position and, if necessary, other intermediate positions.

The invention will be better understood and further objects and advantages will become more apparent from the ensuing detailed specification of a preferred but merely exemplary embodiment taken in conjunction with the drawing.

DESCRIPTION OF THE PREFERRED EMBODIMENT

Figure 1:
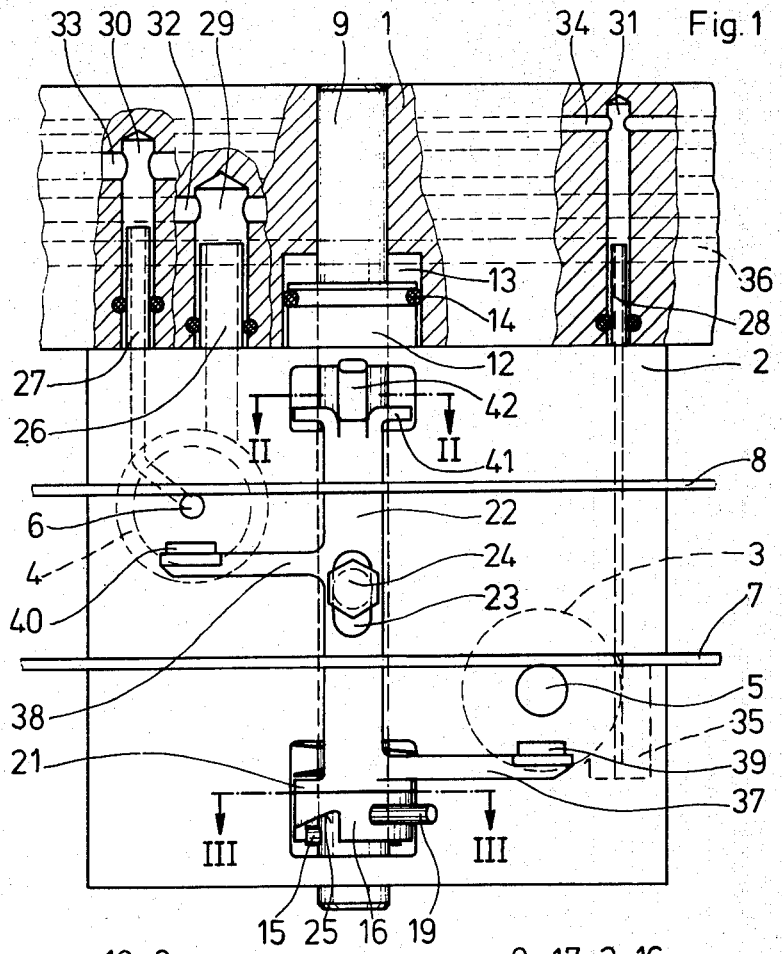
FIG. 1 is a rear view of a member of a spinning machine rail including a housing which contains one open-end spinning unit in the operational position.
Figure 4:
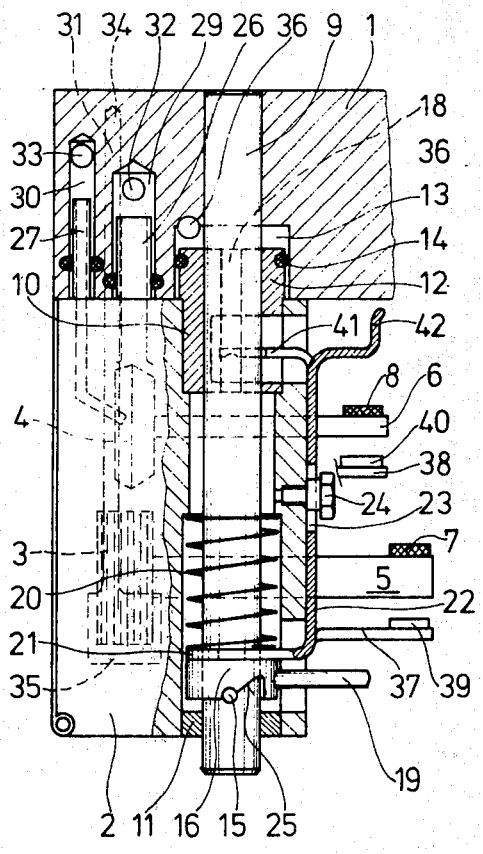
FIG. 4 is a partially broken side view of the machine rail and the housing according to FIG. 1.

Turning now to FIG. 1, there is seen a machine rail 1, possibly constructed of several members, which extends along a side of an open-end spinning machine. Mounted on the machine rail 1 is a plurality of immediately adjacent and identical housings 2 which are vertically movable and of which the figures show only a single one. Each of the housings 2 has a cover and contains an open-end spinning unit, as indicated in FIGS. 1 and 4, including a fiber spreading roller 3 and a spinning rotor 4 whose drive shafts 5 and 6, respectively, extend out of the housing 2 into the region of tangential drive belts 7 and 8, respectively, which are guided alongside the machine. For better visibility in the drawing, the other constructional members of the spinning unit, which would normally be contained in the housing, i.e., the fiber delivery mechanism and the various channels which connect the different parts, as well as other details, are not shown. Obviously the constructional parts could be arranged in another manner than is indicated in this exemplary embodiment.

Figure 5:
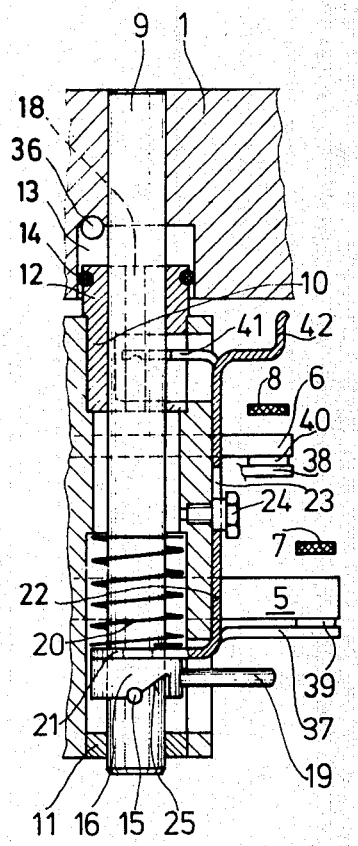
FIG. 5 is an illustration generally similar to FIG. 4 of part of the housing in another position.

Associated with each housing on the machine is a column 9 attached to the machine rail 1 by one end. The housing 2 is slidably mounted on the freely extending portion of the column 9. As may be seen in the figures, the cylindrical column 9 is press-fit into the machine rail, but other methods of fastening, for example, by pins or threads, are also possible. The housing can be guided on the column by a matching internal bore. However, according to the exemplary embodiment, the housing 2 includes a bored recess having regions of different and increasing diameter than the diameter of the column 9 and this bored recess contains two bushings 10 and 11 which glide on the column 9. These bushings are best shown in FIGS. 4 and 5. A portion 12 of the bushing 10 extends from the housing and engages a suitably dimensioned coaxial recess 13 in the machine rail 1, and the clearance between the extending bushing and the recess 13 is sealed by an elastic ring mounted on the bushing portion 12. The portion 12 and its coacting recess 13 are best shown in FIGS. 1, 4 and 5. Once the housing 2 has been placed on the column 9, it may be secured against release by a releasable locking mechanism. In the example shown in the drawing, in which the column 9 is arranged to extend vertically while its free lower end is fastened on the machine rail 1, this locking mechanism locks the housing 2 and prevents its falling from the column 9 due to the gravity. In another embodiment of the column arrangement, for example one in which the free end of the column extends upwardly or in which the longitudinal axis of the column is horizontal, there would, of course, be no danger that the housing might fall from the column.

Figure 3:
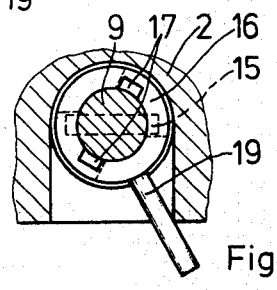
FIG. 3 depicts the mounting of the housing on the machine rail in a top view along the section line III—III of FIG. 1.

One blocking member of this locking mechanism is formed by a stop pin 15 which extends through the column 9 and the opposite blocking member is a ring 16 which envelops the column 9 and which is rotatably mounted in the housing 2. As may be seen especially from FIG. 3, the ring 16 has two diametrically opposite axial grooves 17 which permit the axial displacement of the ring in the region of the stop pin 15 if the ring has an appropriate rotational orientation. In the shown position of the ring 16, however, the pin 15 limits the axial displacement of the ring 16 on the column 9. When the ring 16 has limited axial movement or when it is immovably mounted within the housing 2, this also limits the displacement of the housing with respect to the column 9. The presence of the pin 15 makes it necessary that the bushing 10 be provided with appropriate axial grooves 18 to permit mounting or removal of the housing 2. The cooperating members 15, 16 and 17, which together generally simulate a bayonet-type lock, can be so associated that, when the housing 2 is in its locked position, it is rigidly attached to the machine rail 1 while, at the same time, the driven shafts 5 and 6 are in engagement with the driving belts 7 and 8, respectively.

As shown in the drawing, the ring 16 has an operating lever 19 and it is axially movable within one of the bored recess sections of the housing 2. A compression spring 20 located in this section is supported at one end on the shoulder of the housing which defines this region and at the other end, on the ring 16. The end of the spring does not contact the ring 16 but rests on a bifurcated arm which extends over the ring and which is the angled end-portion 21 of a flat slide 22. This slide 22 has an elongated hole 23 which is penetrated by a screw 24 which is fastened into the housing. In the position shown in FIG. 6, the spring 20 urges the ring 16 into contact with the bushing 11. The flat slide 22 is carried along in this motion due to its end portion 21 and its position which is illustrated is such that it is near the limit of the possible displacement as defined by the combination of the screw 24 and the aperture 23. When the housing 2 is moved up manually from the position shown in FIG. 6 until it makes contact with the machine rail 1, the relative position of the ring 16 with respect to the stop pin 15 becomes such that, after the pin 15 traverses the groove 17 and the associated grooves in the bifurcated arm 21, the pin comes to rest beneath the starting region of axially oblique, ramp-like cam faces 25 provided on the ring 16. The ring 16 is locked by rotating it by means of the operating lever 19, and during this rotation, the ramp surfaces 25 are guided by the free ends of the stop pin 15 so that, while the spring 20 is being compressed and the flat slide 22 is suitably displaced in its arm guidance, the ring 16 is lifted from the bushing 11. When the ring 16 has been rotated until the pin 15 touches the lateral limiting edges of the ramp surfaces 25, it assumes the position shown in FIG. 4, in which the end of the ramp surfaces 25, which are provided with a radial groove, extends over the pin 15 in the manner of a light detent. One end of the spring 20 is supported by the angled end piece 21 of the slide 22, the ring 16 and by the pin 15 and hence, ultimately, by the column 9. Its other end urges the face of the housing into contact with the machine rail 1. As mentioned above, in this first position of the housing, the shafts 5 and 6 are in driving engagement with the belts 7 and 8, respectively, and the known drive means for the fiber delivery mechanism, which are not shown for the sake of clarity, are in driving engagement with primary drive means on the machine.

As may be further seen in FIGS. 1 and 4, arranged to extend from the wall of the housing 2 which faces the machine rail 1 are tubes 26, 27, 28 which are received in corresponding recesses 29, 30 and 31, respectively, via elastic sealing rings. These tubes and the associated recesses are portions of air supply conduits provided between the machine and the housing 2. The recesses are in communication with air conduits 32, 33, 34, respectively, all of which extend alongside the machine rail 1.

The conduit 32 communicates with a source of vacuum and the region containing the spinning rotor 4 and the spreader rollers 3 is provided with the reduced pressure or vacuum required for the spinning process via the partial conduits 29 and 26.

The partial conduits 27 and 30 serve to supply the interior of the spinning rotor with compressed air from the line 33 for purpose of cleaning.

The partial conduit 28 communicates with a chamber 35 associated with one of the spreader rollers; the chamber serves to collect particles of contamination of the fiber bundle which are removed by a suction air stream which prevails either continuously or periodically within the line 34 and hence also in the partial conduit 31.

In addiition to the supply conduits already cited, there may be others, for example a conduit which supplies the required bearing air pressure for a spinning rotor and/or a spreader having an air bearing. In the same manner, receptacles and plugs or other releasable contacts may provide electrical connections between the machine and the housing, for example for a thread breakage monitor or for other electrical monitoring sensing and switching mechanisms. The mutual telescope-like engagement of the partial conduits also provides a rotational security of the housing 2 with respect to the machine rail if the column 9 is of cylindrical cross-section. Such a security may, however, also be provided by appropriate cross-section of the column.

As has already been mentioned, the portion 12 of the bushing extends into the recess 13 in the machine rail which in turn communicates with an air line 36 so that, when the line 36 carries compressed air, the portion 12 of the bushing 10 represents a kind of piston which is displaced in the recess 13 acting as a cylinder. If the air pressure is sufficiently high, the housing 2 is displaced from its position in which it attaches to the rail 1, while overcoming the force of the compression spring 20, and is moved into its second position shown in FIG. 5 which is defined by the contact of the screw 24 at the terminal edge of the elongated hole 23. The flat slide 22 is firmly supported on the column 9 via the ring 16 and the pin 15 and it is provided with two pads 37 and 38 which are so formed and disposed that, during the above-described motion of the housing 2, the extending shafts 5 and 6 come in contact with brake-pads 39 and 40 mounted on the free ends of elastic arms 37 and 38, respectively, so that the rotation of the spreader roller 3 and of the spinning rotor 4 is decelerated.

During the above-described motion of the housing, the communicating supply lines formed between the machine rail 1 and the housing 2 by the telescope-like engagement of the partial conduits remain intact, so that the above-mentioned cleaning can take place at all times by air streams passing through the lines 33 and 34. When the air pressure prevailing in line 36 is either reduced or completely removed, the compression spring 20 is again able to urge the housing 2 into the operational position for the spinning unit as shown in FIGS. 1 and 4.

The apparatus described makes it possible to attach the housing 2 to the column 9 and lock it there in an easily releasable manner and to provide it with an operational position and a rest position which is controlled through the machine.

Due to the disposition of the plurality of housings 2 which are disposed in a tightly juxtaposed position, the plurality of housings covers the machine space lying behind it which contains the belts and other guide means and makes it inaccessible for service and repair or the like. In order to make this space easily accessible without requiring dismounting the housings from their mountings on the columns, the mechanism is provided with a third position which the housings may assume on the column.

Figure 2:
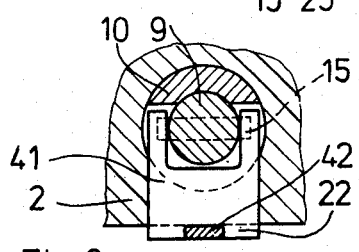
FIG. 2 depicts the mounting of the housing on the machine rail in a top view along the section line II—II of FIG. 1.

For this purpose, the flat slide 22 has a further angled end piece 41 which, in a manner similar to its opposite end piece 21, is bifurcated and arranged to include ears which extend on either side of the column 9, as is shown especially in FIG. 2. When the lock provided between the ring 16 and the stop pin 15 has been released by appropriate rotation of the ring 16, the housing 2 may glide downwardly on the column 9 until the end piece 41 comes in contact with the stop pin 15. Thus the end piece 41 constitutes the counter stop for the stop pin 15. When the pin 15 and the end piece 41 are engaged as shown in FIG. 6, a relatively wide space is opened between the machine rail 1 and the housing 2, making the belts and their guide and tensioning elements, located in the machine space behind the housing easily accessible.

Figure 6:
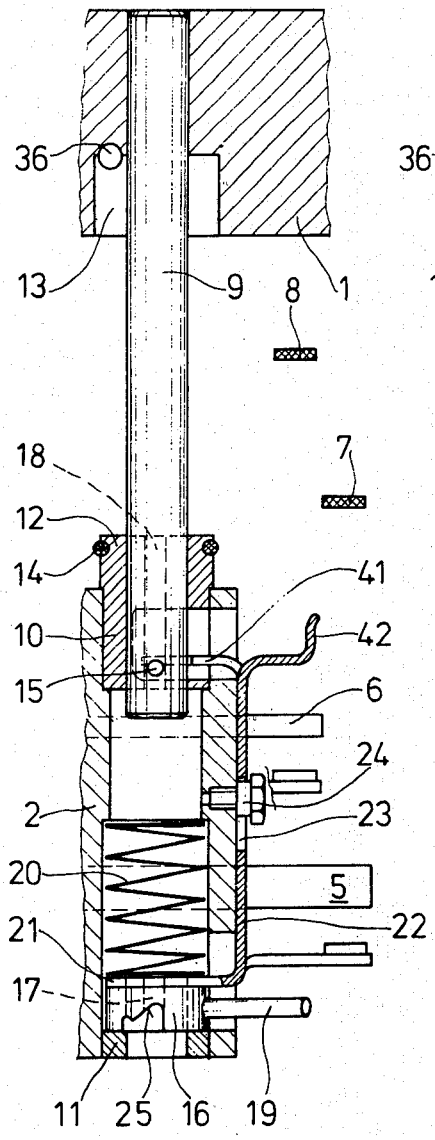
FIG. 6 is also similar to FIG. 5 but shows the partial housing in still another position relative to the machine rail.
Figure 7:
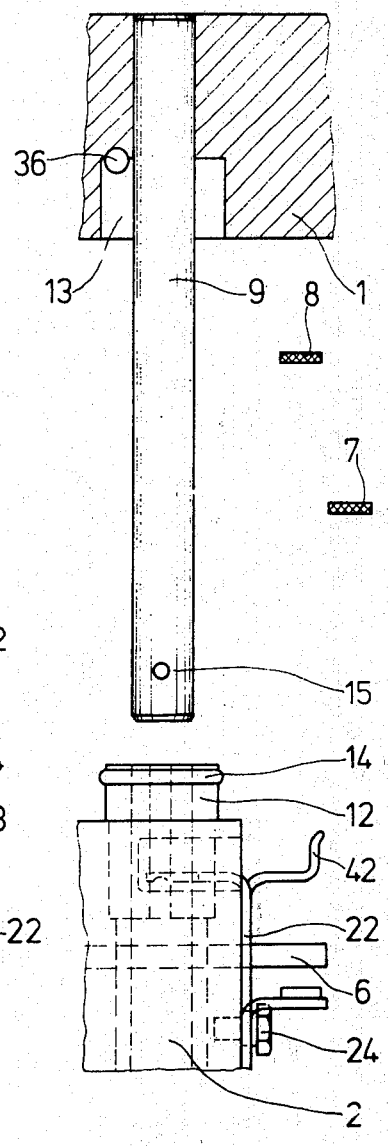
FIG. 7 illustrates the partial housing demounted from the machine.

When the housing moves from the second position shown in FIG. 1 to the third position shown in FIG. 6, the conduits 26, 27, 28 are released from their engagement in the recesses 29, 30, 31, respectively, so that the supply lines are then interrupted.

In order to completely remove the housing 2 from the column 9, the pin 15 and the end piece 41 are disengaged by pulling the inherently elastic flat slide 22 manually by its handle 42 away from the housing 2 as far as necessary until its end piece 41 is free of engagement with the stop pin 15. It would be possible, instead of this engagement, to provide a kind of locking in the sense of a bayonent lock such as or similar to that used for the engagement of the ring 16 and the pin 15. Thus, instead of the end piece 41 being provided on the lever, it would be possible to provide a manually rotatable disc in the housing 2 which could glide over the pin 15 in one position but would be unable to do so in another position.

Another possibility would be to make both end pieces of the flat slide 22 elastic and capable of being bent away from the housing 2 and thus the ring 16 could be eliminated because its function as previously described would be taken over by an end piece of the slide 22 embodied in a similar manner to the end piece 41.

What is claimed is:

1. An open end spinning machine including a rail provided with a plurality of spinning units, each of said units having a rotor, associated fiber delivery rollers, fiber spreading rollers, drive shafts and means for driving said shafts associated with the said spinning machine, comprising:

A. an individual housing associated with each of said spinning units, movably mounted on said spinning machine so as to be capable of causing engagement and disengagement of said drive shafts to and from said drive means;

B. an individual rigid column, associated with each of said individual housings, attached by one end to the spinning machine rail, said column extending partially into said housing to provide said movable mounting of said housing on said spinning machine; and C. an individual locking mechanism, associated with each of said individual housings, capable of releasable arrest of said housing with respect to said column, and including two stop member, the first of said two stop members being in permanent engagement with said column and the second of said stop members being in permanent engagement with said housing, said first and second stop members being also capable of mutual engagement for arresting, positioning and locking said housing on and with respect to said column.

2. An apparatus according to claim 1, wherein said locking mechanism is a mechanism which limits and stops the axial sliding motion of said housing on and with respect to said column.

3. An apparatus according to claim 1, wherein said second stop member includes first and second axially separated counterstops.

4. An apparatus according to claim 3, further including a carrier member, capable of limited motion with respect to the housing in the direction of motion of said housing, said carrier member carrying at least one of said counter stops.

5. An apparatus according to claim 4, further comprising:

D. first means for urging said housing in one of its two axial directions of mobility;

E. second means for urging said housing in the opposite of its two axial directions of mobility; said second means being actuatable arbitrarily and being capable of overcoming the force of said first means.

6. An apparatus according to claim 5, wherein said first means is an energy reservoir.

7. An apparatus according to claim 6, wherein said energy reservoir is a compression spring.

8. An apparatus according to claim 7, wherein said compression spring surrounds said column and is supported at one end by said housing and at the other end by said stop associated with said column.

9. An apparatus according to claim 5, wherein said first means is a compression spring surrounding said column and said second means is a pneumatic mechanism including cylinder means located in the machine and piston means associated with said housing, said cylinder means and said piston means being capable of mutual operative engagement, the apparatus further comprising:

F. first conduits associated with each of said housings; and

G. second conduits associated with said machine and disposed to engage said first conduits in a telescoping manner; whereby the apparatus may occupy a first state in which said first stop member engages said first counter-stop, thus securing the housing on said column while said compression spring urges said housing into surface contact with said machine rail and in which said drive shafts engage said drive means; and may also occupy a second state in which said pneumatic mechanism overcomes the force of said compression spring and which is defined by a terminus of the limited motion of said carrier member and in which said drive shafts are disengaged from said drive means; and may also occupy a third state which is reached after disengagement of said first counterstop from said first stop member and engagement of said first stop member said second counterstop, thus securing said housing on said column, said first and second conduits moving out of engagement during the transition from the second to the third state; and each housing may also be released entirely from said column after disengagement of said second counterstop from said first stop member.

10. An apparatus according to claim 9, wherein said carrier member is a flat slide with limited axial mobility on said housing, provided by cooperation of an elongated hole and a pin fixed in said housing, said flat slide having angled ends which form said first and said second counterstops, wherein said flat slide is also provided with transverse arms which are covered partially with friction-producing pads disposed to cooperate with said drive shafts to reduce the speed thereof.

11. An apparatus according to claim 1, further comprising:

D. first means for urging said housing in one of its two axial directions of mobility;

E. a pneumatic mechanism for urging said housing in the opposite of its two axial directions of mobility; said pneumatic mechanism being actuatable arbitrarily and being capable of overcoming the force of said first means.

12. An apparatus according to claim 11, wherein said pneumatic mechanism includes a source of vacuum located in the machine rail, cylindeer means located in the machine and piston means associated with said housing, said cylinder means and said piston means being capable of mutual operative engagement and being actuated by said source of vacuum.

13. An apparatus according to claim 12, wherein said cylinder means is formed in the wall of the machine rail and said piston means extends from said housing.

14. An apparatus according to claim 11, wherein said piston means is part of a bushing which serves to guide said housing along said column and wherein said cylinder means is a bored recess in the wall of the machine rail, coaxial with said column.

15. An apparatus according to claim 1, wherein said first stop member is a protruding part of said column located near its free end whereas said counterstops are the angled ends of a flat slide held with limited axial mobility on the housing by means of an elongated hole and a pin fixed in said housing.

16. An apparatus according to claim 15, wherein said flat slide is elastic and at least one of its ends serving as one of said counterstops is capable of being moved manually out of the way of said first stop member during relative motion of said housing and said column.

17. An apparatus according to claim 1, wherein said second stop member includes two axially separated counterstops and wherein one of said counterstops is a ring supported on the housing and surrounding said column which forms one part of a bayonet-like locking mechanism and wherein said first stop member forms the other, mating part of said bayonet-like locking mechanism.

18. An apparatus according to claim 1, further comprising:

F. first conduits associated with each of said housings; and

G. second conduits associated with said machine and disposed to engage said first conduits in a telescoping manner.

19. An apparatus according to claim 18, wherein sealing means are provided between said telescoping first and second conduits.

20. An apparatus according to claim 18, wherein said first and second conduits are provided on mutually opposing surfaces of said housings and said machine, respectively.

21. An apparatus according to claim 18, wherein said first and second conduits are of a length which limits their telescoping engagement to only a portion of the axial distance through which said housing may move with respect to said machine.

22. An apparatus according to claim 18, wherein at least one complementary pair of said first and second conduits extends parallel to said column.

23. An apparatus according to claim 1, wherein said column has a longitudinal axis which is disposed perpendicular to said rail and wherein said column is fastened to said machine rail in such a manner that its unattached end points downwardly.

* * * * *